United States Patent [19]

Marchaj

[11] 4,376,616

[45] Mar. 15, 1983

[54] DIFFUSION PUMP

[75] Inventor: Tadeusz J. Marchaj, Long Island, N.Y.

[73] Assignee: Preload Technology, Inc., Garden City, N.Y.

[21] Appl. No.: 890,222

[22] Filed: Mar. 27, 1978

Related U.S. Application Data

[63] Continuation of Ser. No. 662,501, Oct. 15, 1975, abandoned.

[51] Int. Cl.[3] ..... F04F 9/00

[52] U.S. Cl. ..... 417/153; 417/407

[58] Field of Search ..... 417/152–154, 417/405, 406, 245, 355, 407

[56] References Cited

U.S. PATENT DOCUMENTS

| | | | |
|---|---|---|---|
| 1,002,521 | 9/1911 | Kenney | 417/405 X |
| 1,970,917 | 8/1934 | Ricker | 417/406 X |
| 3,171,355 | 3/1965 | Harris | 417/406 X |
| 3,182,896 | 5/1965 | Bachler | 417/154 |
| 3,353,742 | 11/1967 | Bowman et al. | 417/154 |

FOREIGN PATENT DOCUMENTS

| | | | |
|---|---|---|---|
| 570351 | 2/1959 | Canada | 417/355 |
| 476207 | 3/1929 | Fed. Rep. of Germany | 417/355 |
| 1317333 | 1/1963 | France | 417/154 |

*Primary Examiner*—Edward K. Look

*Attorney, Agent, or Firm*—Curtis, Morris & Safford

[57] ABSTRACT

An improved vacuum diffusion pump is shown. The pump consists of the conventional elements of a pump body with inlet and outlet ports, a vaporizer, a vapor jet assembly such as a vapor chimney within the pump body and cooling means associated with the outer walls of the pump body. A fan is positioned between the top of the vapor chimney and the inlet port of the diffusion pump. When rotated, the fan drives oil vapors "backstreaming" from the pump body downwardly into and against the walls of the pump body. The fan may be driven by external means but preferably is driven by a turbine positioned in or near the vapor chimney and attached to either an axial shaft supported within the chimney or directly to the fan itself. The turbine is driven by the fast moving oil vapors and in turn drives the shaft or directly rotates the fan. A cap for the chimney may also be fixed to the shaft and rotated therewith, thereby imparting a tangential flow to vapors passing out of the chimney. The invention substantially avoids the problem of "backstreaming" and improves the performance characteristics of the vacuum pump.

4 Claims, 5 Drawing Figures

DIFFUSION PUMP

This is a continuation of application Ser. No. 662,501, filed Oct. 15, 1975, now abandoned.

This invention relates broadly to a diffusion pump. More specifically, this invention relates to improved oil diffusion pumps of novel structure which achieve performance results heretofore unobtainable in the art. Even more specifically, this invention relates to oil diffusion pumps comprising chimney-type vapor jet assemblies, and having a fan located in or near the inlet port to prevent "backstreaming", the fan being driven by the oil vapors within the chimney.

Oil diffusion pumps have been widely used in industry for creating and securing very high vacuums. Typically, they operate by vaporizing a silicone oil or other high boiling oil, as a pumping fluid, in a closed container. The oil vapors pass through a jet assembly at high velocity and are deflected against the cooled, internal wall of the pump body. The high speed vapor stream entrains gas molecules from the area being evacuated and compresses these molecules into a high pressure exhaust port. Typically, the exhaust port is in communication with one or more other diffusion pumps or machanical pumping systems. The high velocity vapor stream is condensed by contact with the wall of the pump body and the condensed liquid is returned to a boiler for further evaporation.

The major limitation on the performance of oil diffusion pumps is created by the phenomenon known as "backstreaming", which is the leakage of oil vapors from the diffusion pump into the area to be evacuated. The high velocity vapor stream created in the boiler and passed through the jet assembly against the cooling surfaces of the pump is not always completely condensed and some minor amounts of oil vapor find their way into the zone which is to be evacuated. This decreases the high vacuum and may also cause contamination of the evacuated zone.

Several diffusion pump designs have been suggested for reducing or eliminating the problem of "backstreaming." Typically, such diffusion pumps employ specially designed and optically dense baffle systems located either in the inlet port or upstream thereof. It is also known to water-cool such baffles or to interpose a plurality of them in the area between the pump and the zone to be evacuated. Another technique which has been suggested is that of cooling one or more of the vapor jet nozzles in order to condense the vapor passing therethrough. Still other systems require "cryogenic traps" requiring special seal and cryogenic supply systems.

Such design features serve to condense any oil vapors escaping from the pump and flowing towards or into the zone to be evacuated. While the installation of such systems may partially eliminate the problems of "backstreaming" they are typically expensive to install and maintain, they may engender vapor leaks and they may create an impedance to the flow of vapors from the zone to be evacuated into the diffusion pump. This either lessens the capacity of the pump or necessitates the use of larger pumps to maintain a prescribed vacuum.

Although many solutions have been proposed incorporating either baffles or novel cooling surfaces, or combinations of these, none has been completely effective in eliminating the problem of "backstreaming" and all, in addition to adding to the cost of the diffusion pump, either reduce the ultimate vacuum which can be achieved by the pump or lengthen the time required to reach prescribed vacuum conditions.

It is thus the primary object of this invention to provide a vacuum diffusion pump which eliminates or reduces the inefficiencies due to "backstreaming".

It is a further and related object of this invention to provide a vacuum diffusion pump which achieves higher ultimate vacuum conditions or reaches specified conditions faster than has been possible before, without requiring additional complexity of design and cost.

It is another and related object of this invention to eliminate the need for cryogenic traps and special seals as are required in state of the art diffusion pumps.

It is still a further object of this invention to provide inserts for existing vacuum pumps which will improve their performance characteristics.

It is yet a further and related object of this invention to avoid the inherent cost disadvantages and inefficiencies of heretofore proposed baffling and/or special cooling systems.

It is yet a further object of this invention to harness the kinetic energy in the oil vapor in vacuum diffusion pumps into redirecting the flow of oil vapor "backstreaming" into the evacuated zone.

It is still a further object of this invention to create flow conditions within the body of a vacuum pump which improve the efficiency of the condensation surfaces and thereby improve overall pump performance.

These and other objects of this invention are achieved in a vacuum diffusion pump comprising a pump body, inlet and outlet ports, a vaporizer or boiler for vaporizing a motive fluid such as oil, a vapor jet assembly for the oil vapor and cooling/condensing means for the oil, and further including a fan, rotatably positioned between the jet assembly and the space to be evacuated, such fan being rotated either by means external to the vacuum diffusion pump or by rotational power generated within the pump itself, as is further described below. Thus in its broadest embodiment, the instant invention comprises a chimney-type vacuum pump having a fan rotatably positioned between the chimney and the inlet port of the vacuum pump. The vanes of the fan rotor are positioned so as to impart a velocity to oil molecules coming in contact therewith, downwardly into the pump body and outwardly against the cooling walls of the pump body. Likewise, any molecules of gas being evacuated coming into contact with the vanes of the fan, are directed through it and downwardly and outwardly into the pump body. The fan may be rotated by drive means within the pump as, for example, by a battery and rotary motor. Alternatively, the fan may be rotated by a shaft leading to a power source external to the pump body and sealed therefrom, or may be rotated by means of a magnetic field imposed about the pump body.

In a preferred embodiment, the fan is driven by a shaft which is in turn rotated by a turbine rotatably positioned within the vapor jet assembly and which is rotatable by the oil vapors passing therethrough. Thus a preferred embodiment embraces a diffusion pump comprising a cylindrical pump body having an inlet port in an upper part thereof and an outlet port in a lower part thereof and housing a boiler within the bottom part thereof. Any suitable motive fluid known for such applications can be used in the pump, although typically silicone oil is the fluid of choice. The interior of the pump body includes at least one substantially cylindrical, and concentrically positioned vapor chimney. The chimney communicates at its lower end with the vapor zone of the boiler, while the annular zone defined between the chimney and the internal cylindrical surface of the pump body communicates with the liquid zone of the boiler. The pump body typically has cooling coils or jackets incorporated within it so as to provide a cooling and condensing surface for the oil vapors, on the interior wall of the pump body.

An axial shaft is positioned within the chimney and is rotatably retained in position by one or more support and guide bearings. An axial turbine rotor adapted to be driven by the upwardly flowing oil vapors which pass through the chimney from the boiler is rotatably positioned within the vapor chimney and is affixed to the shaft. A cap for the chimney is concentrically and rotatably positioned above the chimney and affixed to the shaft. The cap defines, with the chimney top, an annular effluent port at which motive fluid vapors are deflected downwardly and outwardly within the annular zone defined by the chimney and the pump. Above the chimney cap and attached to an upper portion of the shaft is the fan rotor. It is positioned either within or downstream of, i.e. below, the inlet port, and the vanes on the fan rotor are positioned so as to impel molecules of oil vapors downwardly into and outwardly against the walls of the pump.

The turbine is driven by the vapors passing upwardly through the chimney. The velocity of these vapors is very high and the turbine serves to convert energy supplied by the vaporizer at the bottom of the chimney into rotational energy in the axial shaft. Only a small portion of the kinetic energy is converted by the turbine and the rate of revolution can be controlled by proper setting of the turbine rotor vanes. Alternatively, stator vanes may be incorporated within the chimney to guide the flowing vapor and more efficiently direct it into the turbine rotor vanes. The power required to rotate the fan attached to the shaft is, however, not great because the fan is rotating in high vacuum space and therefore the gas resistance against it is negligibly small. The frictional resistance of the bearings supporting and positioning the axial shaft may also be limited. Thus the tangential velocity of the fan blades can reach the velocity of gas molecules in high vacuum space and each collision of a gas molecule with a fan blade will cause the molecule to be redirected downwardly and outwardly into the pump body. In this manner, "backstreaming" is substantially reduced.

A high degree of performance efficiency is also contributed by the rotating chimney cap. As will be understood, all molecules of vapor contacting the rotating cap will be impelled tangentially to the cap as well as deflected downwardly within the annular zone defined between the chimney and the pump body. The tangential velocity component imparted by the rotating cap will increase the degree of contact between the vapor molecules and the side walls of the pump body, thereby increasing condensation efficiency.

In a second embodiment, the fan and turbine are integrally connected. A radial turbine rotor is supported below the fan and is positioned in the annular effluent port defined between the chimney top and a fixed chimney cap. The turbine is driven by the motive fluid vapors which have been deflected downwardly and outwardly through the annular zone and the rotation of the turbine is directly imparted to the integral fan. One major advantage of this embodiment is that the orientation of the radial turbine blades and the rotation of the turbine itself, creates a velocity component in the motive gases tangential to the cooling walls of the pump body. Gases passing through the radial turbine thus have downward, outward and tangential velocity components and the vortex effect is beneficial to the condensation efficiency of the pump body. The simpler drive train is a further advantage.

The invention is further described below in the accompanying drawings, wherein.

Figure 1:
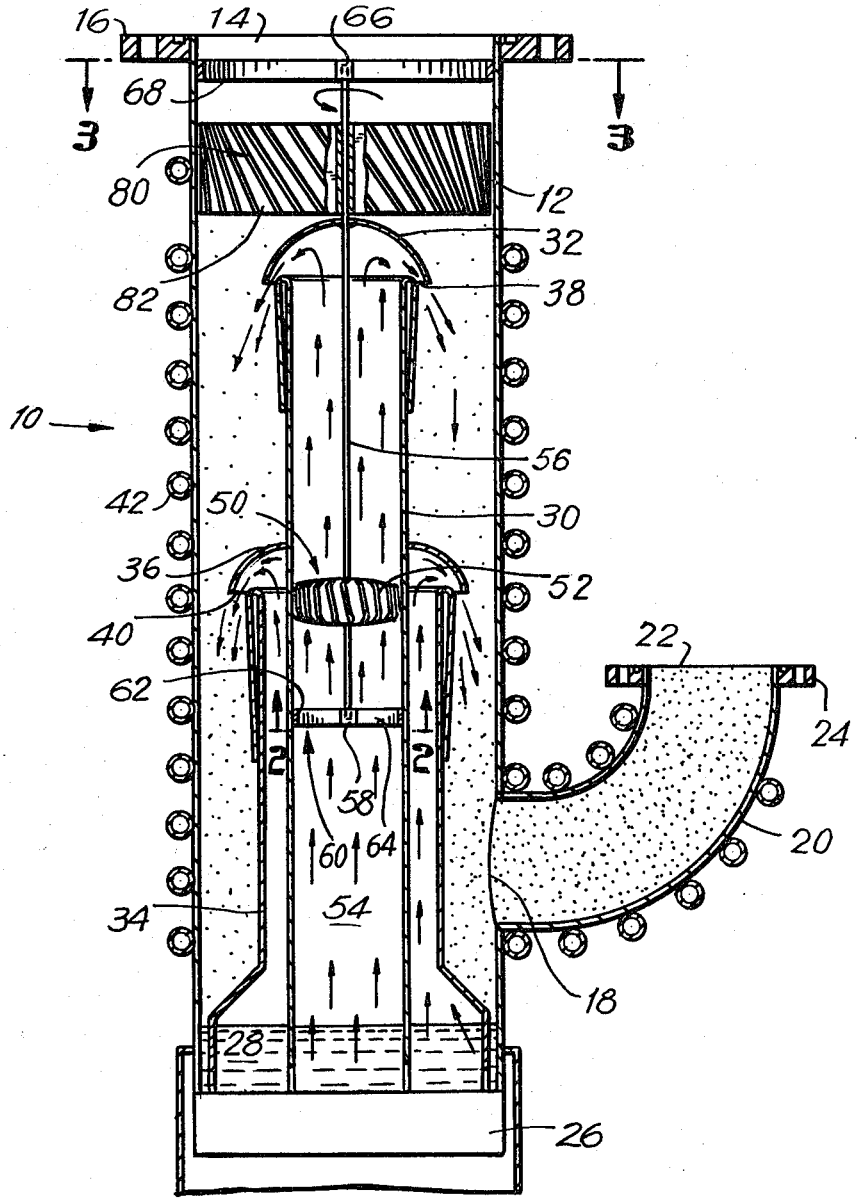
FIG. 1 is a elevation view, in section, of a vacuum diffusion pump according to the invention having an axial turbine.

Turning to FIG. 1, reference 10 refers generally to an oil diffusion pump. Pump 10 is comprised of a cylindrical pump body 12 having an inlet port 14 constituting the open upper end of cylindrical body 12. Port 14 is encircled by flange 16 which is adapted for connection to a vessel to be evacuated. Pump body 12 also includes outlet port 18 in a lower part thereof and outlet conduit 20 leading to the forepressure line 22 which is encircled by flange 24 adapted to mate with flanges associated with further vacuum pumps or mechanical vacuum pumping systems.

Pump body 12 houses a vaporizer or boiler zone 26 containing liquid oil 28 which is vaporized by heating elements such as electrical coils or heated base plate, not shown. Vaporizer 26 communicates at the central part thereof with chimney 30 which extends upwardly for nearly the entire height of pump body 12 and is capped by rotatable cap 32. A second and lower chimney 34 is positioned concentrically outwardly of chimney 30 and it is capped by cap 36. Reference numeral 40 refers to the annular effluent port defined between chimney 34 and cap 36. The outer wall of pump body 12 is provided with cooling coils 42 through which is pumped a cooling liquid for condensation of the oil vapors in the pump body. The discharge of vapors through the effluent port of the chimney at high speeds draws or entrains gas molecules from the area being evacuated, i.e., at or upstream of inlet 14 in known manner.

In accordance with the invention and to prevent "backstreaming" of molecules of oil vapor from pump body 12 via inlet port 14 to the space to be evacuated, the following structure is provided. An axial shaft 56 is rotatably supported in support bearing 58 which is centrally positioned in chimney 30 by means of bearing support ring 60 including ring member 62 and radial struts 64. Shaft 56 extends upwardly and is attached first to a turbine rotor 50, having vanes 52 which are oriented to the upwardly flowing gas indicated by reference numeral 54. The axial shaft 56 is connected to the center axis of turbine rotor 50 and is rotatably driven thereby.

Shaft 56 extends above turbine rotor 50 and is integrally connected to concentrically positioned cap 32 located above chimney 30. Reference numeral 38 refers to the annular effluent port defined between rotatable cap 32 attached to shaft 56 and the topmost part of chimney 30.

Situated above rotatable cap 32 is fan 80, which consists of a rotor and blades 82. The fan is rigidly secured to shaft 56 for rotation therewith. The angle of blades 82 is set to deflect gases with which a fan 80 comes in contact, downwardly into pump body 12 and outwardly against the cylindrical side wall thereof, in order to increase the effectiveness of cooling coils 42. Molecules of gas being evacuated from the evacuation zone are likewise impelled downwardly and outwardly from fan 80. As shown, fan 80 is optically dense.

Shaft 56 extends further upwardly above fan 80 and is rotatably retained in guide bearing 66. Bearing 66 is suitably supported in a bearing ring 68 which includes a ring member and struts as in lower support ring 60. The bearing arrangement may be widely varied and additional guide bearings may be provided either within chimney 30, between rotatable cap 32 and fan 80 or above fan 80. Further bearing configurations will be apparent to those skilled in the art.

In operation, the motive fluid is vaporized in boiler 26, passes upwardly through chimneys 30 and 34 and is deflected downwardly through effluent ports 38 and 40. The rapidly moving oil vapors entrain with them vapors of a gas to be evacuated which pass into pump body 12 via inlet port 14 and are thrust through outlet port 18 to forepressure line 22. The combined effect of rotating cap 32, which imparts a tangential velocity to molecules of oil vapor, and rotating fan 80, which deflects "backstreaming" molecules of vapor downwardly and outwardly against the cooled side walls of pump body 12, is to very substantially increase the performance efficiency of the vacuum pump. With the novel structure, it is possible to achieve higher ultimate vacuums and to achieve such vacuums faster than in conventional pumps. An associated advantage is that less impurities find their way into evacuated space.

Figure 3:
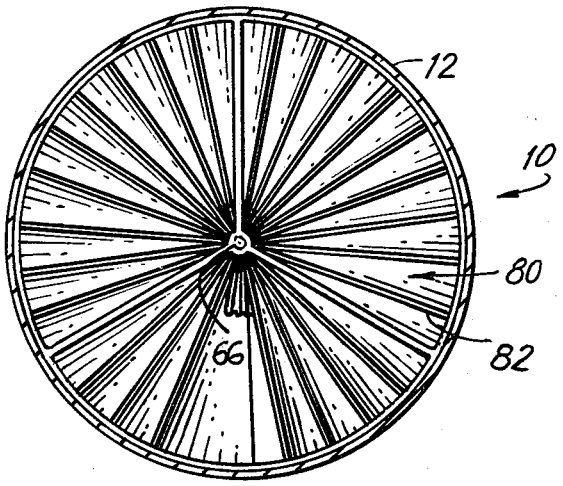
FIG. 3 is a plan view of the shaft guide support shown in FIG. 1, taken along lines 3—3 of FIG. 1.
Figure 2:
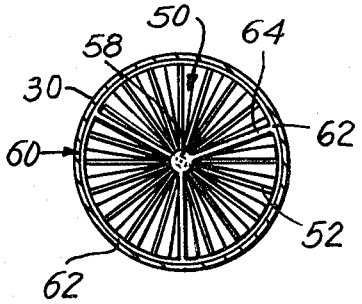
FIG. 2 is a plan view taken along lines 2—2 of FIG. 1.
Figure 4:
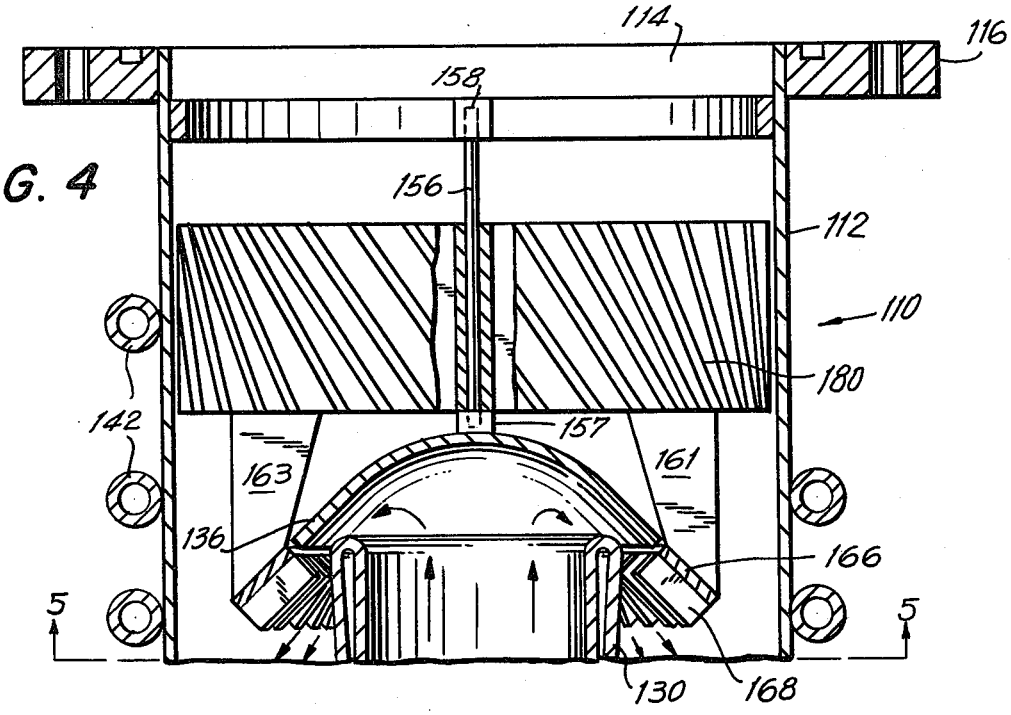
FIG. 4 is an elevation view, in section, of the upper part of a vacuum diffusion pump according to the invention having a radial turbine.
Figure 5:
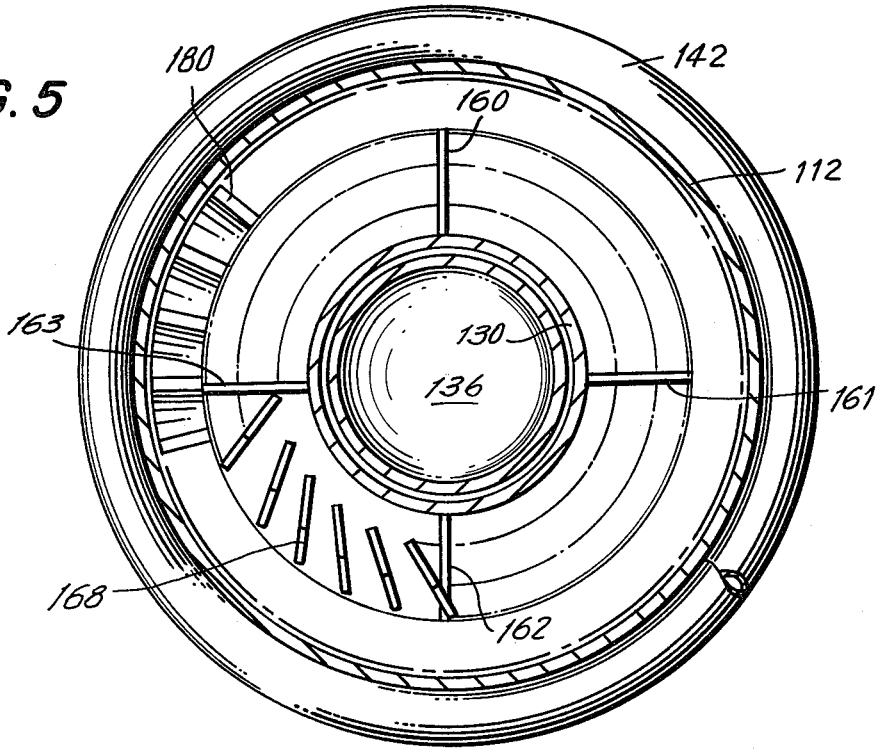
FIG. 5 is a plan view taken along lines 5—5 of FIG. 4.

FIGS. 4 and 5 show the radial turbine embodiment of the invention. The lower part of pump is the same as that described in FIGS. 1, 2 and 3. Reference numeral 110 identifies the pump, numeral 112 the pump body, numeral 114 the inlet port and numeral 116 the flanges. The vapor chimney 130 is shown as is a fixed non-rotatable, chimney cap 132. Situated above cap 132 and below inlet port 114 is fan 180 similar to fan 80 described above in connection with FIGS. 1, 2 and 3. Fan 80 is mounted upon central shaft 156 which is supported from below in support bearing 157 centrally positioned on fixed chimney cap 132 and retained above in guide bearing 158. Chimney cap 132 may be fixedly supported by a central support post and/or by struts attached to chimney 130 or by other suitable supports. The details of the bearings and bearing rings may be similar to those described above or may be varied as will be apparent to those skilled in the art.

Attached to the bottom of fan 80 are support members 160, 161, 162 and 163 which extend downwardly to radial turbine rotor 166 having radial blades 168. Turbine rotor 166 and blades 168 are positioned substantially in and slightly outwardly and downwardly of the annular effluent port defined between the top of chimney 130 and chimney cap 136. In operation the gases passing outwardly and downwardly through the annular effluent port impinge upon blades 168 causing rotation of turbine rotor 166 and integrally connected fan 180. The resulting vortex flow within the pump body improves the condensation efficiency of pump walls 112 which are cooled by coils 142.

The invention is useful in the design of new vacuum pumps or in the adaptation of existing vacuum pumps by providing these with adapter inserts comprising a central shaft, turbine, fan and the associated bearings.

Other embodiments of the invention may occur to workers in the art. For example, straightening vanes may be provided in the chimney and above the turbine to stabilize the direction of the flowing gases and thereby increase the efficiency of the turbine. In fractionating vacuum pumps, turbine means may be provided in one or more of the concentric, parallel chimneys in order to harness the motive power of the rising gases. Still further refinements of the turbine drives will occur to those skilled in the art.

What is claimed is:

1. A vacuum pump adapted to prevent backstreaming of motive vapor molecules into the space to be evacuated, comprising:

(a) a cylindrical pump body having an inlet port in an upper part thereof and an outlet port in a lower part thereof;

(b) boiler means housed within the bottom part of said pump body for vaporizing a motive fluid;

(c) at least one, substantially cylindrical, vapor chimney positioned within said pump body, communicating at its lower end with said boiler and discharging vaporized motive fluid from the boiler into said pump body, said pump body and chimney defining an annular zone therebetween;

(d) cooling means surrounding the exterior of said cylindrical pump body for condensing motive fluid vapors within said annular zone;

(e) a fan rotor rotatably positioned adjacent said inlet port, said rotor including vanes positioned to impel motive fluid and evacuated vapors downwardly into said cylindrical pump body;

(f) a cap for said chimney fixedly positioned above said chimney, said cap and chimney top defining an annular effluent port, said cap deflecting motive fluid vapors downwardly within the annular zone defined by said chimney and pump body; and (g) radial turbine means rotatably positioned adjacent said annular effluent port and connected to said fan.

2. A diffusion pump as recited in claim 1, wherein said fan and radial turbine are integrally connected.

3. A diffusion pump adapted to prevent backstreaming of motive vapor molecules into the space to be evacuated, comprising:

(a) a cylindrical pump body having an inlet port in an upper part thereof and an outlet port in a lower part thereof;

(b) boiler means housed within the bottom part of said pump body for vaporizing a motive fluid;

(c) at least one, substantially cylindrical vapor chimney concentrically positioned within said pump body, communicating at its lower end with said boiler and discharging vaporized motive fluid from the boiler into said pump body, said pump body and chimney defining an annular zone therebetween;

(d) a cap for said chimney fixedly positioned above said chimney, said cap and chimney top defining an annular effluent port, said cap deflecting motive fluid vapors downwardly within the annular zone defined by said chimney and pump body;

(e) a fan rotor rotatably positioned adjacent said inlet port, said fan rotor including vanes positioned to impel motive fluid and evacuated vapors downwardly into said cylindrical pump body; and (f) a radial turbine positioned adjacent the said annular effluent port defined between the top of said chimney and said chimney cap, and vertical support means depending downwardly from said fan for connecting said fan to said turbine, whereby rotation of the turbine causes rotation of the fan.

4. A diffusion pump as recited in claim 3 wherein said fan includes a central axle rotatably supported in a support bearing located on top of and on the axis of said chimney cap and being rotatably guided in a guide bearing positioned above said fan.

* * * * *